US005531884A

United States Patent [19]

Johnson et al.

[11] Patent Number: 5,531,884

[45] Date of Patent: Jul. 2, 1996

[54] FCC CATALYST STRIPPER

[75] Inventors: David L. Johnson, Glen Mills, Pa.; Richard C. Senior, Cherry Hill, N.J.

[73] Assignee: Mobil Oil Corporation, Fairfax, Va.

[21] Appl. No.: 285,248

[22] Filed: Aug. 3, 1994

[51] Int. Cl.[6] ..... C10G 9/36

[52] U.S. Cl. ..... 208/150; 208/151; 208/153; 422/189; 422/191; 422/196

[58] Field of Search ..... 208/151, 150; 422/144, 189, 191, 196

[56] References Cited

U.S. PATENT DOCUMENTS

| | | | |
|---|---|---|---|
| 2,900,325 | 8/1959 | Rice et al. | 208/151 |
| 3,380,911 | 4/1968 | Owen | 208/151 |
| 3,690,841 | 9/1972 | Bunn, Jr. et al. | 208/151 |
| 4,574,044 | 3/1986 | Krug | 208/151 |
| 4,738,829 | 4/1988 | Krag | 208/151 |
| 4,789,458 | 12/1988 | Haddad et al. | 208/151 |
| 4,921,596 | 5/1990 | Chon et al. | 208/151 |
| 4,946,656 | 8/1990 | Ross et al. | 422/144 |
| 5,059,305 | 10/1991 | Sapre | 208/151 |
| 5,310,477 | 5/1994 | Lomas | 208/151 |
| 5,380,426 | 1/1995 | Johnson | 208/151 |

*Primary Examiner*—Helane Myers
*Attorney, Agent, or Firm*—Alexander J. McKillop; Malcolm D. Keen; Richard D. Stone

[57] ABSTRACT

A fluidized catalytic cracking (FCC) process and apparatus uses a catalyst stripper with slant trays or shed trays having "downcomers". Downcomers, vertical catalyst/gas contacting elements, provide a vertical, countercurrent region for catalyst/stripping vapor contact. The downcomers improve stripping effectiveness.

18 Claims, 5 Drawing Sheets

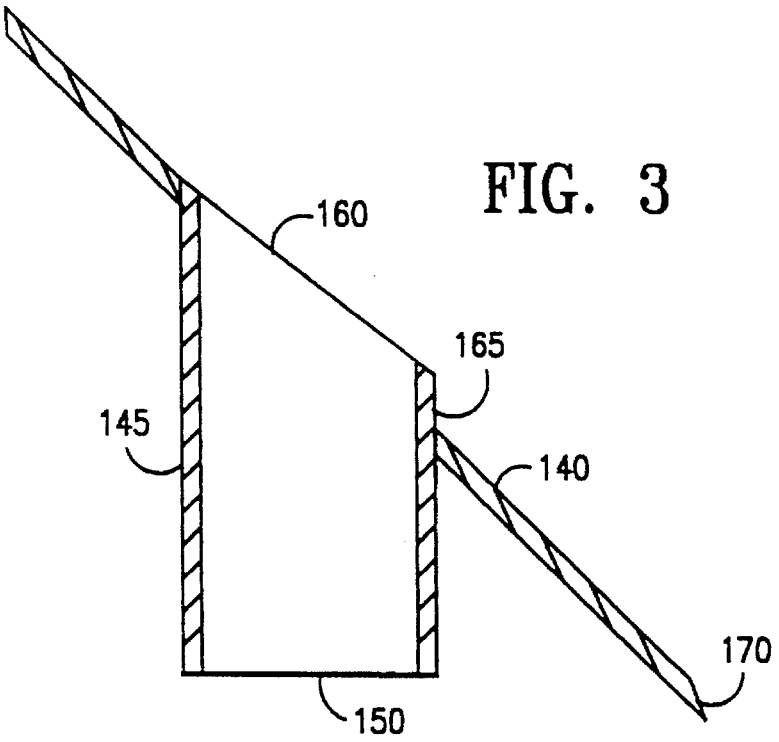
FIG. 3
FIG. 5
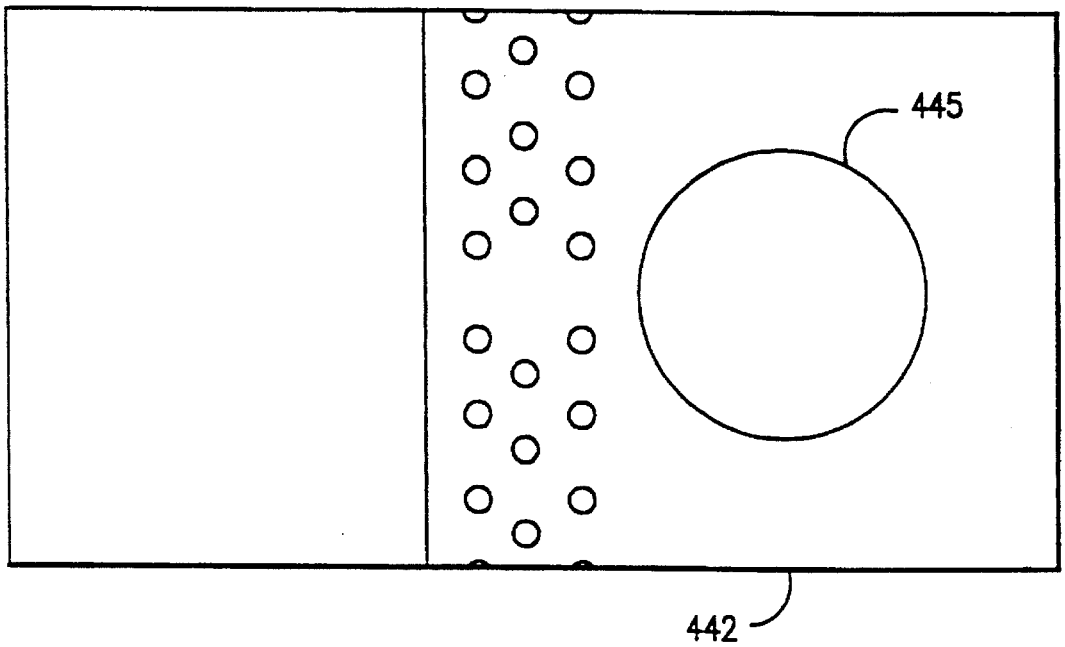

FCC CATALYST STRIPPER

BACKGROUND OF THE INVENTION

1. Field of the Invention

The field of the invention is fluidized catalytic cracking (FCC) in general and catalyst stripping in particular.

2. Description of Related Art

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants in catalytic cracking: moving bed and the far more popular and efficient fluid bed process.

In fluidized catalytic cracking (FCC), catalyst, having a particle size smaller than, and color resembling, table salt and pepper, circulates between a cracking reactor and a catalyst regenerator. In the reactor, hydrocarbon feed contacts hot, regenerated catalyst. The hot catalyst vaporizes and cracks the feed at 425° C.–600° C., usually 460° C.–560° C. The cracking reaction deposits carbonaceous hydrocarbons or coke on the catalyst, thereby deactivating it. The cracked products are separated from the coked catalyst. The coked catalyst is stripped of volatiles, usually with steam, in a catalyst stripper and the stripped catalyst is then regenerated. A catalyst regenerator burns coke from the catalyst with oxygen containing gas, usually air. Decoking restores catalyst activity and simultaneously heats the catalyst to, e.g., 500° C.–900° C., usually 600° C.–750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, recycled to the reactor in the form of hot catalyst.

Catalytic cracking has undergone much development since the 40s. The trend of development of the FCC process has been to all riser cracking and zeolite catalysts.

Riser cracking gives higher yields of valuable products than dense bed cracking. Most FCC units now use all riser cracking, with hydrocarbon residence times in the riser of less than 10 seconds, and even less than 5 seconds.

Zeolite based catalysts of high activity and selectivity are now used in most FCC units. These catalysts allowed refiners to increase throughput and conversion, as compared to operation with amorphous catalyst. The zeolite catalyst effectively debottlenecked the reactor section, especially when a riser reactor was used.

Another development occurred which debottlenecked the FCC regenerator—CO combustion promoters. To regenerate FCC catalysts to low residual carbon levels refiners used to add limited amounts of air. Coke was burned to CO and $CO_2$, but air addition was limited to prevent afterburning and damaging temperature excursions in the regenerator.

U.S. Pat. Nos. 4,072,600 and 4,093,535, which are incorporated by reference, taught adding Pt, Pd, Ir, Rh, Os, Ru and Re in concentrations of 0.01 to 50 ppm, to allow CO combustion to occur within the dense bed of catalyst in the regenerator. CO emissions were eliminated, and regenerators were now limited more by air blower capacity than anything else.

To summarize, zeolite catalysts increased the capacity of the cracking reactor. CO combustion promoters increased the capacity of the regenerator to burn coke. FCC units now had more capacity, which could be used to process worse feeds or achieve higher conversions. Constraints on the process, especially for units already in operation, could now shift to some other place in the unit, such as the wet gas compressor, main column, etc.

One way refiners took advantage of their new reactor and regenerator capacity was to process feeds that were heavier, and had more metals and sulfur. These heavier, dirtier feeds pushed the regenerator, and exacerbated existing problems in the regenerator—steam and temperature. These problems show up in the regenerator and are reviewed in more detail below.

STEAM

Steam deactivates FCC catalyst. Steam is not intentionally added to the regenerator, but is invariably present, usually as adsorbed or entrained steam from steam stripping of catalyst or as water of combustion formed in the regenerator.

Poor stripping leads to a double dose of steam in the regenerator, first from the adsorbed or entrained steam and second from "fast coke" or hydrocarbons left on the catalyst due to poor catalyst stripping. These hydrogen-containing unstripped hydrocarbons burn in the regenerator to form water and steam the catalyst, deactivating it.

U.S. Pat. No. 4,336,160 to Dean et al, reduces catalyst steaming by staged regeneration. This requires major capital expenditures.

Steaming became even more of a problem as regenerators got hotter, as higher temperatures accelerate steam deactivation.

TEMPERATURE

Regenerators now operate hotter. Most FCC units are heat balanced, the endothermic heat of cracking is supplied by burning the coke deposited on the catalyst. With worse feeds, more coke deposits on the catalyst than is needed for the cracking reaction. The regenerator runs hotter, so the extra heat can be rejected as high temperature flue gas. Regenerator temperature now limits many refiners in the amount of resid or high CCR feeds which can be tolerated by the unit. High temperatures are a problem for the metallurgy of many units, but more importantly, are a problem for the catalyst. In the regenerator, the burning of coke and unstripped hydrocarbons leads to higher surface temperatures on the catalyst than the measured dense bed or dilute phase temperature. This is discussed by Occelli et al in *Dual-Function Cracking Catalyst Mixtures,* Ch. 12, Fluid Catalytic Cracking, ACS Symposium Series 375, American Chemical Society, Washington, D.C., 1988.

High temperatures make vanadium more mobile and promote formation of acidic species which attack zeolite structure, leading to loss of activity. Some efforts at controlling regenerator temperature will now be reviewed.

Some regenerator temperature control is possible by adjusting the CO/CO2 ratio in the regenerator. Burning coke partially to CO produces less heat than complete combustion to CO2. However, in some cases, this control is insufficient, and also leads to increased CO emissions, which can be a problem unless a CO boiler is present.

The prior art used dense or dilute phase regenerator heat removal zones or heat-exchangers remote from, and external to, the regenerator to cool hot regenerated catalyst for return to the regenerator. Such approaches help, but are expensive, and some units do not have space to add a catalyst cooler.

Although these problems showed up in the regenerator, they were not a fault of poor regeneration, but rather an indication that a new pinch point had developed in the FCC process.

The reactor and regenerator enjoyed dramatic increases in capacity due to changes in the catalyst. The old hardware could now do more.

Thanks to zeolite cracking catalyst, the reactor side cracked more efficiently. Some refiners even reduced reactor volume to have all riser cracking. Thanks to Pt, the regenerator could now run hotter without fear of afterburning. Many existing regenerators were if anything oversized, and now became killing chambers for active zeolite catalyst.

Improvements in stripping technology did not match those occurring in the reactor and regenerator. Increased catalyst and oil traffic was easily and profitably handled by the reactor and the regenerator, but not by the stripper. Poor catalyst stripping was now the source of much of the problems experienced in the FCC regenerator.

We wanted to avoid treating the symptom rather than the disease. Only as a last resort should refiners take excess heat from the regenerator with coolers, or go to multistage regeneration so that some catalyst regeneration occurs in a drier atmosphere.

The key had to be in reducing waste. It was better to reduce the amount of unstripped hydrocarbons burned in the regenerator, rather than deal with unwanted heat release in the regenerator. There was a special need to:

- remove more hydrogen from spent catalyst to minimize hydrothermal degradation in the regenerator;
- remove more sulfur-containing compounds from spent catalyst before regeneration to minimize SOx in flue gas; and
- reduce to some extent the regenerator temperature.

Although much work has been done on stripping designs, reliability has been considered more important than efficiency. Most strippers contain relatively large, slanted plates to aid stripping. Thus in many FCC strippers chevron plates, shed trays or inclined trays at 30–60 degree angles are used to improve catalyst/stripping steam contact. Steep angles and large openings are needed both because FCC catalyst has poor horizontal flow characteristics and because large pieces of concrete and/or dome coke can and do fall into the stripper.

Refiners fear horizontal surfaces, such as those used in a bubble cap tray. Flat surfaces develop stagnant regions where catalyst can "set up" like concrete. Under flat surfaces bubbles of hot cracked vapors can undergo thermal reactions.

Refiners use steep angles in their strippers. Catalyst flows smoothly through the stripper, but gas contacting is often poor. In a typical design, an annular stripper disposed about a riser reactor, the goal is to have upflowing gas contact downflowing catalyst circumferentially distributed around a central riser reactor.

Many current stripping designs are so poor that an increase in stripping steam may not improve stripping. In some units, added stripping steam causes dilute phase transport of spent catalyst into the regenerator. Stripping may still be improved if there is better settling or deaeration of spent catalyst just above the stripper.

Refiners with overloaded FCC catalyst strippers thus have a serious problem. None of the possible solutions are attractive.

The obvious solution, putting in a much larger stripper to deal with the anticipated catalyst flux, can not be done at a reasonable cost. The stripper is closely integrated with the rest of the FCC, usually as part of the reactor vessel, and modifications are expensive. The reactor vessel is or becomes a bit out of round, and enlarging the stripper, so that it merges with a larger ID portion of the reactor vessel requires extensive fit-up work.

It is also possible to increase the catalyst capacity of existing slanted plate strippers by making each tray shorter. This could be visualized as converting a disc and doughnut stripper to one with alternating layers of speed bumps on inner and outer surfaces of the stripper annulus. This provides more area for catalyst flow, but promotes bypassing (steam up and catalyst down) through the stripper. An additional problem is that it is expensive to shorten the trays, they need to either be replaced completely (introducing fit-up problems) or modified extensively in place. These modifications involve cutting back the trays, adding new steam distribution holes to replace the ones cut out, and welding a new tray lip on.

A way has now been found to get better stripping of coked FCC catalyst by modifying the current stripper design to retain much or all of the existing tray area.

Basically the modification is addition of relatively large "downcomers" to the conventional stripper trays. The downcomers look similar to those used in vapor/liquid fractionators but do not perform the same function. Thus to an extent, the term "downcomer" is actually a misnomer. In fractionators downcomers move liquid from an upper tray to a lower tray, and the bottom of the downcomer is sealed so that no vapor may pass up through the tray.

We use downcomers to provide an efficient region for countercurrent catalyst and vapor flow. We use downcomers to conduct efficient stripping, rather than merely move fluid from an upper elevation to a lower one. About the only thing our downcomers and fractionator downcomers have in common is that our downcomer helps preserve the static head of pressure which exists under the tray. Despite the different function of our stripper "downcomers", the term will be readily understood by those skilled in the cracking arts, and provides one useful way to describe our improvement.

BRIEF SUMMARY OF THE INVENTION

Accordingly, the present invention provides a fluidized catalytic cracking process wherein a heavy hydrocarbon feed comprising hydrocarbons having a boiling point above about 650° F. is catalytically cracked to lighter products by contact with a circulating fluidizable catalytic cracking catalyst inventory of particles having a size ranging from about 20 to about 100 microns, by catalytically cracking the feed in a catalytic cracking reactor operating at catalytic cracking conditions by contact with regenerated catalyst to produce a cracking reactor effluent mixture of cracked products and spent catalyst containing coke and strippable hydrocarbons; discharging and separating the effluent mixture into a cracked product rich vapor phase and a solids rich phase of spent catalyst; removing the vapor phase as a product; stripping the spent catalyst by countercurrent contact with stripping vapor to produce stripped catalyst and stripper vapor in a stripper vessel having a plurality of slanted trays for horizontal and vertical transfer of catalyst as it passes down through the stripper, the trays having a slanted surface affixed at an upper portion to a wall of the stripping vessel and a lower portion terminating in the interior of the stripper; at least one inlet in a lower portion for stripping vapor; at least one outlet in a lower portion to discharge stripped catalyst; at least one outlet in an upper portion for stripper vapors; and wherein downcomers are provided in at least some of the slant trays, said downcomers having: an inlet in an upper portion thereof fluidly connected with a slant tray; a generally vertical catalyst downcomer section having an upper portion terminating in said inlet and a lower portion extending beneath said slant tray.

In another embodiment, the present invention provides a fluidized catalytic cracking process wherein a heavy hydrocarbon feed comprising hydrocarbons having a boiling point above about 650° F. is catalytically cracked to lighter products by contact with a circulating fluidizable catalytic cracking catalyst inventory consisting of particles having a size ranging from about 20 to about 100 microns, comprising catalytically cracking said feed in a catalytic cracking reactor operating at catalytic cracking conditions by contacting feed with a source of regenerated catalyst to produce a cracking reactor effluent mixture comprising cracked products and spent catalyst containing coke and strippable hydrocarbons; discharging and separating said effluent mixture into a cracked product rich vapor phase and a solids rich phase comprising spent catalyst; removing said cracked product rich vapor phase as a product; stripping said solids rich spent catalyst phase by countercurrent contact with stripping vapor to produce stripped catalyst and stripper vapor in a stripper vessel having a plurality of slant trays blocking from 20 to 80% of a cross sectional area of said stripper vessel at a plurality of elevations in said stripper vessel for horizontal and vertical transfer of catalyst as it passes down through said stripper, each slant tray having an upstream portion receiving spent catalyst discharged and separated from said cracking reactor or from a superior tray, a downstream portion discharging spent catalyst from a tray edge or lip across and down to an inferior tray, and an upper and a lower surface; at least one inlet in a lower portion of said stripping vessel for stripping vapor; at least one outlet in a lower portion of said stripping vessel for discharge of stripped catalyst; at least one outlet in an upper portion of said stripping vessel for discharge of stripper vapors; and vertical conduits in at least some of said slant trays comprising a combined spent catalyst inlet and vapor outlet passing through said slant tray which is fluidly connected with said upper surface of said slant tray, a combined spent catalyst outlet and vapor inlet beneath at least a portion of said lower surface of said slant tray and above said slant tray lip or edge, and a generally vertical conduit having an upper portion terminating in said combined inlet and outlet and a lower portion terminating in said combined outlet and inlet; transporting stripped catalyst discharged from said stripper to a catalyst regenerator; regenerating stripped catalyst by contact with oxygen containing gas to produce regenerated catalyst; and recycling said regenerated catalyst to said cracking reactor.

In an apparatus embodiment, the present invention provides an apparatus for the fluidized catalytic cracking of a hydrocarbon feed comprising a reactor having an inlet in a base portion for a hydrocarbon feed and for regenerated catalyst withdrawn from a regenerator vessel and an outlet for cracked vapor products and spent catalyst; a reactor vessel receiving and separating said cracked vapor products and spent catalyst discharged from said reactor, and having an outlet for vapor and an outlet in a lower portion for spent catalyst; a catalyst stripper in a stripping vessel comprising a plurality of trays which are slanted or in the shape of an inverted "V" at a plurality of elevations for horizontal and vertical transfer of catalyst as it passes down through said stripper, each tray having an upstream portion receiving spent catalyst from a superior tray or from said spent catalyst outlet of said reactor vessel, a downstream portion discharging spent catalyst from a tray edge or lip across and down to an inferior tray, and an upper and a lower surface; at least one inlet in a lower portion of said stripping vessel for stripping vapor; at least one outlet in a lower portion of said stripping vessel for discharge of stripped catalyst; at least one outlet in an upper portion of said stripping vessel for discharge of stripper vapors; and vertical conduits in at least some trays comprising a combined spent catalyst inlet and vapor outlet passing through said tray which is fluidly connected with said upper surface of said tray, a combined spent catalyst outlet and vapor inlet beneath at least a portion of said lower surface of said tray and above said tray lip or edge, and a generally vertical conduit having an upper portion terminating in said combined inlet and outlet and a lower portion terminating in said combined outlet and inlet; a stripped catalyst transfer means having an inlet connected to said stripped catalyst outlet and an outlet connected to said regenerator vessel; and said catalyst regenerator vessel having an inlet for spent catalyst connected to said stripped catalyst transfer means, a regeneration gas inlet, an outlet for regenerated catalyst connected to said reactor, and at least one flue gas outlet.

BRIEF DESCRIPTION OF THE DRAWINGS

FIG. 3 (Invention) shows details of a single downcomer.

FIG. 5 (Invention) shows details of cross section of the FIG. 4 stripper, with an elevation view of a downcomer.

DESCRIPTION OF PREFERRED EMBODIMENTS

Figure 1:
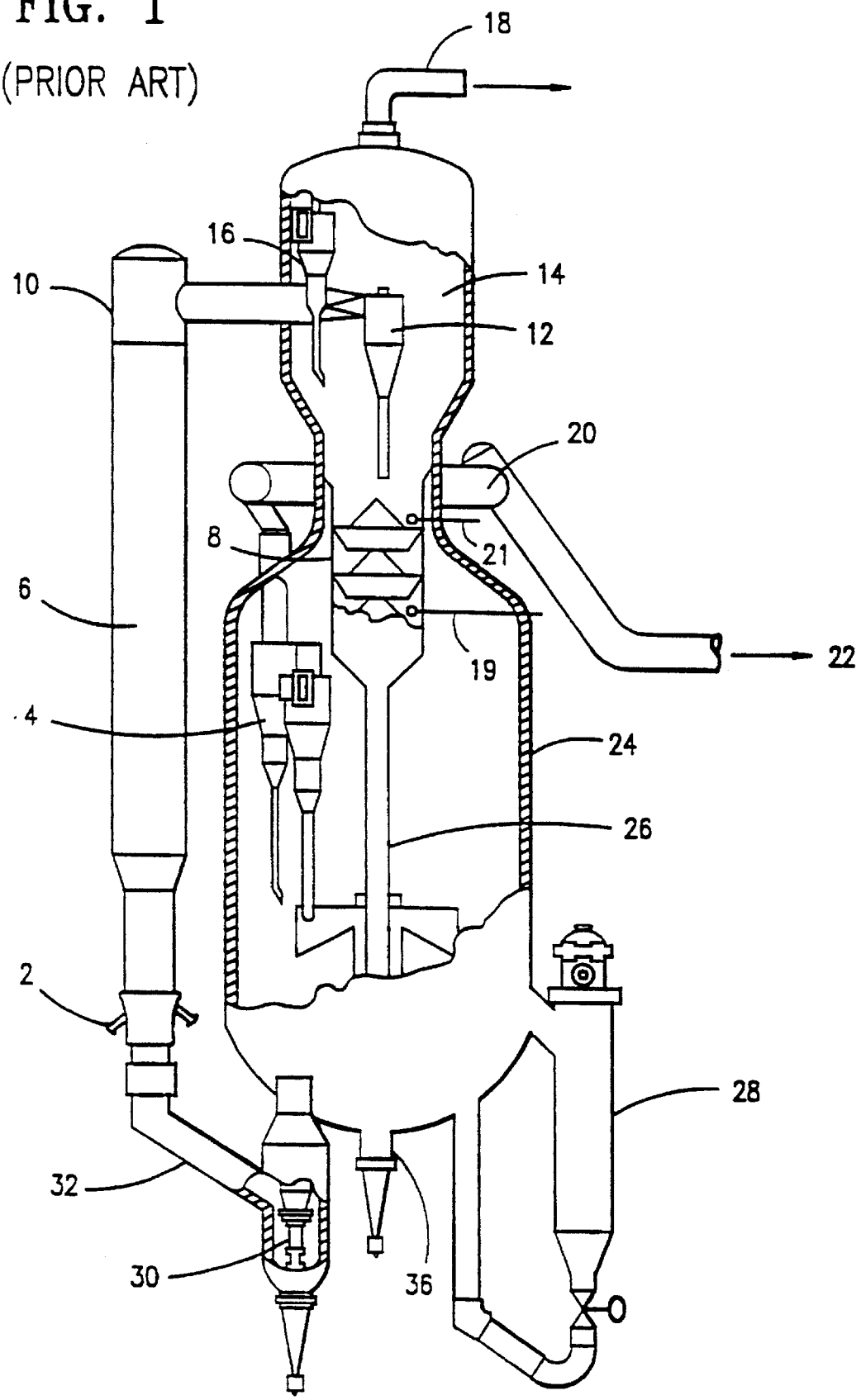
FIG. 1 (PRIOR ART)
FIG. 1 (Prior Art) shows a simplified schematic view of an FCC unit with a conventional stripper.

FIG. 1, a simplified schematic view of an FCC unit of the prior art, will be discussed first, followed by a review of preferred types of commercially available packing material, and an FCC stripper of the invention.

The prior art FCC (FIG. 1) is similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 18 to the fractionator.

Spent catalyst is discharged down from a dipleg of riser cyclones 12 into catalyst stripper 8, where one, or preferably 2 or more, stages of steam stripping occur, with stripping steam admitted via lines 19 and 21. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

This stripper design is one of the most efficient in modern FCC units, due in large part to its generous size. Most FCC's have strippers disposed as annular beds about a riser reactor, and do not provide as much cross sectional area for catalyst flow as the design shown in FIG. 1.

Catalyst is regenerated in regenerator 24 by contact with air, added via air lines and an air grid distributor not shown. A catalyst cooler 28 is provided so heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, are discharged into a dilute phase region in the upper portion of regenerator 24. Entrained catalyst is separated from flue gas in multiple stages of cyclones 4, and flue gas discharged via outlets 8 into plenum 20 for discharge to the flare via line 22.

Thus FIG. 1 defines the environment in which our process operates—conventional FCC processing. More details about FCC stripping, and the "downcomer" or vertical catalyst/gas contacting means of the invention, are provided in conjunction with a review of FIGS. 2–5, followed by a presentation of comparison tests in a laboratory stripper (FIG. 6) and a discussion of an actual commercial test of our invention.

Figure 2:
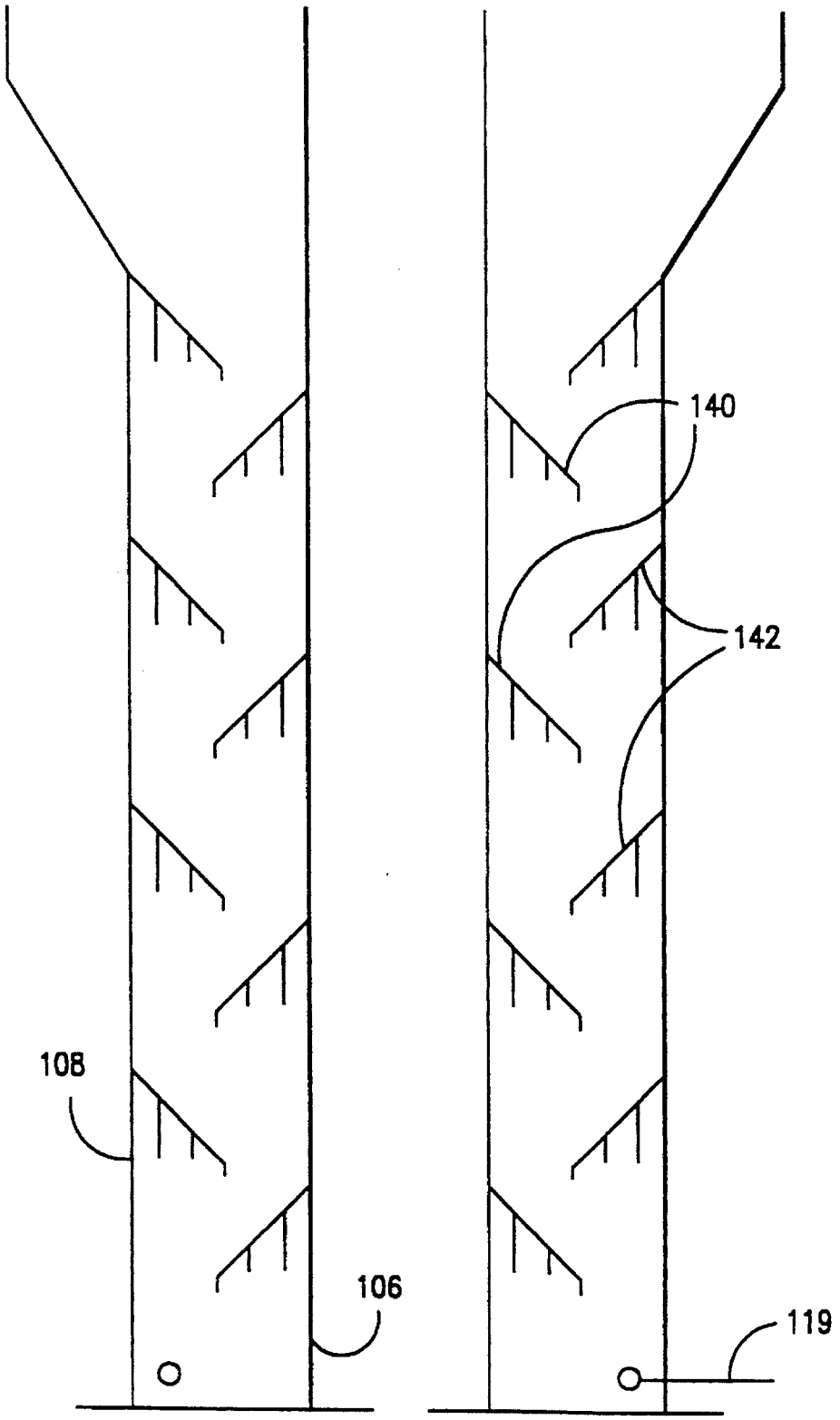
FIG. 2 (Invention) shows a side view of an FCC stripper with downcomer slant trays.

FIG. 2 (Invention) shows details of a side view of an FCC riser reactor 106 passing through an annular stripper 108 with downcomer slant trays. There are multiple layers of inner slant trays 140 and outer slant trays 142. The inner trays 140 are affixed to the riser reactor while the outer slant trays 142 are affixed to the walls of stripping vessel 108. Steam or other stripping medium is admitted via distribution means 119, typically a ring in the base of the stripper.

FIG. 3 (Invention) shows details of a single downcomer device. Slant tray 140 contains downcomer 145, a length of pipe cut horizontal at the base 150 but at a shallower angle at the top portion 160 so that lip 165 is provided. Lower edge 170 of slant tray 140 is shown terminating at an elevation somewhat below the base 150 of downcomer 145. This allows the downcomer to tap into the bubble of higher pressure gas which exists under slant tray 140, providing some static head to promote gas flow up through the downcomer. Lip 165 may help divert downflowing spent catalyst into downcomer 145, or at least prevent premature discharge of stripping vapor through the space occupied by lip 165.

Figure 4:
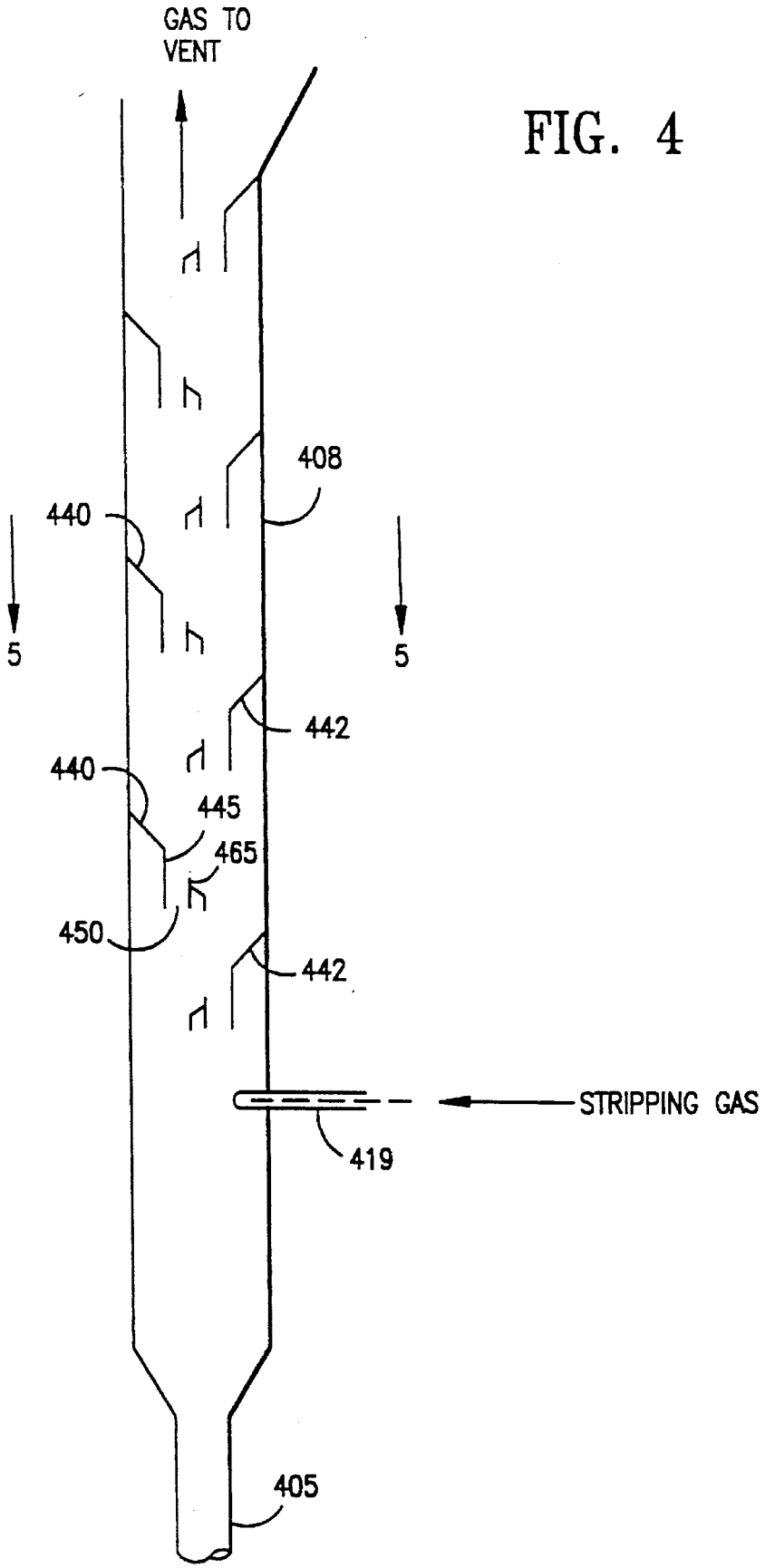
FIG. 4 (Invention) shows details of laboratory test setup of a stripper with downcomers.

FIG. 4 (Invention) shows details of laboratory test setup of a stripper with downcomers. Stripper 408 was designed for continuous operation.

Catalyst enters the top of stripper 408 and passed over a series of alternating right baffles 442 and left baffles 440. Stripping gas, admitted via gas distribution means 419, passes counter-current against downflowing catalyst. Vapor is removed from an upper portion of stripper 408, while stripped catalyst is removed via outlet 405. Catalyst is recirculated by means not shown.

All baffles are roughly symmetrical. A typical left baffle 440 contains downcomer 445, a section of a cylinder cut horizontally at the base 450 and on an angle at the upper portion thereof so that it extends up through tray 440 to provide a lip 465. Thus the upper portion of the downcomer is flush with tray 440 where the downcomer passes through the highest portion of tray 440 and rises, relatively to the tray surface, to a high point where the downcomer passes through the lowest portion of tray 440.

FIG. 5 (Invention) shows details of cross section of the FIG. 4 stripper, taken along lines 5—5. This elevation view of downcomer 442 shows the circular outline of downcomer 445.

Figure 6:
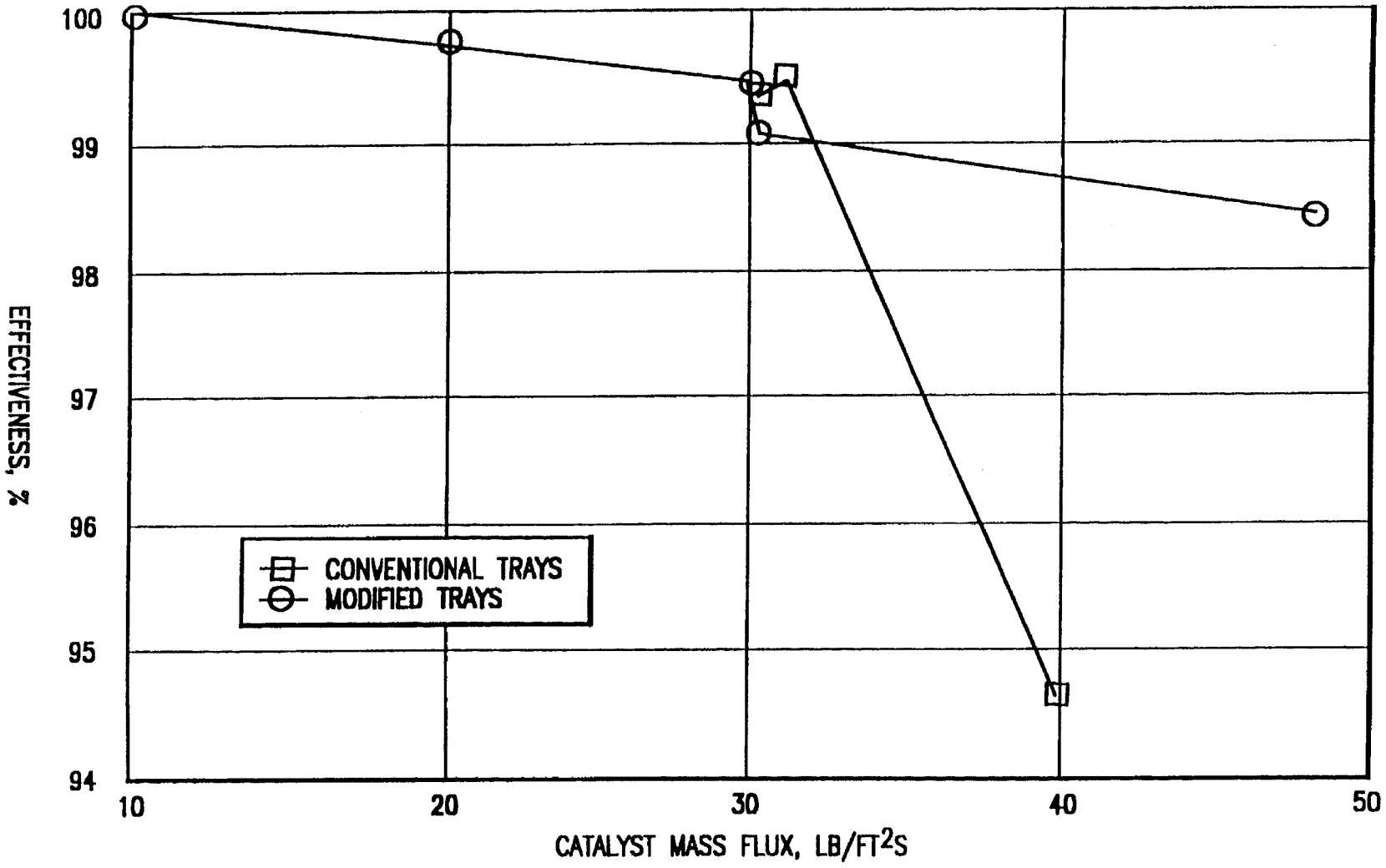
FIG. 6 is a graph of comparison tests of a conventional stripper and a stripper with "downcomers" (invention).

FIG. 6 is a graph of comparison tests of a conventional stripper (no downcomers) and a stripper with downcomers (invention).

Now that the invention has been reviewed in connection with the embodiments shown in the figures, a more detailed discussion of the different parts of the process and apparatus of the present invention follows. Many elements of the present invention can be conventional, such as the cracking catalyst, so only a limited discussion of such elements is necessary.

FCC FEED

Any conventional FCC feed can be used. The feeds may range from the typical, such as petroleum distillates or residual stocks, either virgin or partially refined, to the atypical, such as coal oils and shale oils. The feed may contain recycled hydrocarbons, such as light and heavy cycle oils which have already been subjected to cracking. Preferred feeds are gas oils, vacuum gas oils, atmospheric resids, and vacuum resids.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

The catalyst inventory may contain one or more additives, either present as separate additive particles or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOx (alumina), remove Ni and V (Mg and Ca oxides). CO combustion promoters, such as those disclosed in U.S. Pat. Nos. 4,072,600 and 4,235,754, incorporated by reference, may be used. Very good results are obtained with as little as 0.1 to 10 wt. ppm platinum present on the catalyst in the unit.

The FCC catalyst composition, per se, forms no part of the present invention.

FCC REACTOR CONDITIONS

Conventional FCC reactor conditions may be used. The reactor may be either a riser cracking unit or dense bed unit or both. Riser cracking is highly preferred. Typical riser cracking reaction conditions include catalyst/oil ratios of 0.5:1 to 15:1 and preferably 3:1 to 8:1, and a catalyst contact time of 0.5–50 seconds, and preferably 1–20 seconds, and riser top temperatures of 900° to 1200° F., preferably 950° to 1050° F.

The FCC reactor conditions, per se, are conventional and form no part of the present invention.

CATALYST STRIPPING APPARATUS

The catalyst stripper will generally be an existing one, with many or all of the existing slant trays or slant plates modified by incorporation of downcomers or other equivalent vertical gas/solids contacting means.

Stripping may be in multiple stages or a single stage. Stripping steam may be added at multiple levels in the stripper or only near the base.

The dimensions of the stripper can be set using conventional criteria. In most units an existing stripper will be modified by adding downcomers as shown in the Figures.

We can operate with downcomers which add from 1 to 40% open area (based on horizontal cross sectional area of the stripper at the inlet to the downcomer). We prefer to operate with downcomers having an internal open area equal to 2 to 30%, and most preferably from 5 to 20% of the cross sectional area of the stripper. In many commercial FCC catalyst strippers, adding downcomers or vertical transport/contact means with a cross sectional area equal to about 10% of the stripper horizontal cross sectional area will give excellent results.

These areas can also be expressed as % of slant tray area, if desired, with appropriate recalculation. A slant tray will have a much larger surface area than the horizontal cross sectional area of the stripper covered by the tray.

The downcomers should generally be staggered, to minimize bypassing. A downcomer outlet should not discharge directly into a downcomer inlet. Downcomers should be vertical, though they generally will have a slanting inlet section conforming to the surface of the slant tray to which the downcomer is attached.

The location of the downcomer in each slant tray is preferably such that it roughly splits the area on each side of the downcomer tray. For an annular stripper, the downcomers preferably are uniformly radially distributed. The surface area of each tray should also be split into two portions, an inner surface and an outer surface, with the dividing line being a circle drawn through the center of each downcomer.

The top of each downcomer should conform generally to the slant of the slant tray to which it is attached. We prefer to have a slight lip or extension at the top of the downcomer, on the downstream or lowermost portion of the downcomer spent catalyst inlet. If the slant trays were at 45 degrees from the vertical, then the top of the pipe used to form the downcomer might be cut to form an angle of 50–55 degrees from the vertical so that the lowermost portion of the top of the downcomer extended somewhat above the slant tray. The uppermost portion of the top of the downcomer could be installed flush to the slant tray, while the lowermost portion extended, e.g., ¼" to 1" or more.

This lip on the downstream side of the spent catalyst inlet is intended to make some use of the dynamic head of catalyst flowing down the slant tray, diverting catalyst down into the downcomer.

This use of a lip on the catalyst inlet to increase catalyst dynamic head gives the downcomer a disproportionate share of the catalyst flowing down. We prefer to couple this increased dynamic head with an offsetting vapor flow, generated by static head beneath the slant tray, as discussed below. The downcomer base or catalyst outlet is preferably horizontal and preferably extends down no further than the lowermost edge of the slant tray to which it is attached. Some slant trays have a lip, which acts as an extension of the tray. Preferably the downcomer catalyst outlet is so situated that it taps a reservoir of higher pressure stripping vapor which exists under each slant tray. To do this the base of the downcomer should terminate within the region of higher pressure under the slant tray, the "bubble" which forms in the region bounded by an inner or outer wall of the stripper and the slant tray. This is a region of somewhat higher pressure formed by natural hydrodynamic forces as spent catalyst flows down the stripper and stripping gas flows up. If the base of the downcomer is situated in this region of localized high pressure, there is some pressure head available to act as a driving force promoting gas flow up through the downcomer. We believe that recessing the bottom of the downcomer outlet roughly ½ to 5", and preferably 1 to 4", above the lowermost edge or bottom lip of the slant tray, provides the ideal amount of static head to make the downcomer an active contacting zone.

Although we prefer to use vertical, cylindrical pipes for our downcomers, this is not essential. Other shapes may be used as well, though not necessarily with equivalent results. The horizontal cross section of the downcomer may be a rectangle, triangular, oval, etc.

We prefer to use fairly large downcomers. This gives a robust design, which is not likely to plug, and reduces field fabrication costs because it reduces the number of downcomers that must be added to the slant trays. Pipe as small as 2" in diameter could be used, but we are concerned about plugging. The downcomer diameter should not exceed 90% of the horizontal footprint of the slant tray. In most commercial installations use of 4" to 12" diameter pipe will give good results, with 6" to 10" pipe preferred.

Many refiners will be afraid to put so many, and so large, holes/downcomers in their slant tray strippers.

CATALYST STRIPPING CONDITIONS

Conventional stripping conditions may be used. The process of the invention permits refiners to operate with less stripping steam than before. It is believed that the optimum use of the invention will be more catalyst traffic, rather than merely reducing steam rates.

At low catalyst flow rates our design is not significantly better than the old design. The significance of our design is that much better stripper performance is achieved at high catalyst throughputs.

Typical FCC strippers operate with the catalyst at roughly the riser outlet temperature—usually 900° to 1100° F., typically 950° to 1050° F. Catalyst may be stripped with 0.5 to 10 lb steam per 1000 lb catalyst preferably 1 to 5 lb of steam per 1000 lb catalyst.

CATALYST REGENERATION

The FCC unit may use any type of regenerator, ranging from single dense bed regenerators to fast fluid bed designs. Some means to regenerate catalyst is essential, but the configuration of the regenerator is not critical.

The temperatures, pressures, oxygen flow rates, etc., are within the broad ranges of those heretofore found suitable for FCC regenerators, especially those operating with substantially complete combustion of CO to CO2 within the regeneration zone. Suitable and preferred operating conditions are:

| | Broad | Preferred |
|---|---|---|
| Temperature, °F. | 1100–1700 | 1150–1400 |
| Catalyst Residence Time, Seconds | 60–3600 | 120–600 |
| Pressure, atmospheres | 1-10 | 2–5 |
| CO2/CO | 1–infinite | 2–infinite |

Catalyst coolers may be used, if desired. Such devices are useful when processing heavy feeds, but many units operate without them. In general, there will be less need for catalyst coolers when practicing our invention, because more efficient stripping of catalyst reduces the amount of fuel (unstripped hydrocarbons) that must be burned in the regenerator. Better stripping also reduces the steam partial pressure in the regenerator (by removing more of the hydrogen rich "fast coke" on spent catalyst in the stripper) so the catalyst can tolerate somewhat hotter regenerator temperatures.

EXAMPLES

Several sets of experiments were run, starting with a cold flow test involving He tracer and ending with a commercial test in an operating refinery.

COLD FLOW TESTS

The test apparatus used was basically that shown in FIGS. 4 and 5 (Invention) and the same equipment operating with conventional slant trays (no downcomers). The unit had a cross section measuring 11"×21", and was approximately 40 feet tall. Catalyst circulation was controlled by a single slide valve below the stripper which emptied catalyst into a riser. This recirculated the catalyst to three stages of cyclones with diplegs discharging to the top of the stripper. Catalyst circulation rates as high as 2.5 tons per minute, tpm, were used in testing the various configurations. Helium was used as a tracer to check the stripper performance, with He injected at the top of the stripper in the primary cyclone diplegs. The concentration of He was monitored at the base of the unit to determine stripper effectiveness.

Tests were run at conditions used to simulate solids-gas flow in conventional FCC strippers. For safety and convenience, air was used as the "stripping gas", at a superficial vapor velocity of 1.4 feet/second. The tests were run at near ambient temperatures, rather than the 900°– 1100° F.+ temperatures customarily used in commercial FCC units, hence the name "cold flow".

Various catalyst flux rates were tested, ranging from 10 to 40 pounds of catalyst per square foot of cross sectional area in the stripper. In terms of FCC conditions, this simulated where many FCC units operate commercially, i.e., moderately high stripping steam rates and mass flux ranging from low to fairly high. Effectiveness is the percentage of He tracer injected into the stripper which was stripped out. 100% means that all He was stripped out, while 97% means there was 3% unstripped helium, etc. This is an excellent laboratory method, but does not correspond to, e.g., 97% removal of strippable hydrocarbons from spent catalyst.

Results of the cold flow tests are graphically presented in FIG. 6. The results show that at low catalyst mass flux rates there is little difference between the conventional stripper design and the stripper of the invention with downcomers. Both designs work well. There was no penalty due to piercing the slant trays with large diameter downcomers.

At high catalyst flow rates, which corresponds to where most refiners run all the time, or would like to have the option to run, our design is far superior to the conventional stripper. There is some loss of efficiency using our design at higher flow rates, as might be expected, but there is no significant loss of stripping effectiveness as occurs with a conventional stripper design. The conventional stripper has a marked decrease in effectiveness at high catalyst flux.

COMMERCIAL TEST

The stripper in a commercial FCC was modified by incorporating downcomers into the stripper trays. The stripper was an annular stripper, modified to include downcomers, and is similar to the annular stripper shown in FIG. 2.

The stripper internal radius was 7'. The riser tray radius was 5.75'. The radius of a circle encompassing the centers of the inner tray downcomers was 4.92'. Conventional steam vent and weep holes were present before and after addition of downcomers. The riser reactor radius was 3.84'.

The inner tray downcomers were 18 lengths of 10" schedule 40 pipe with a 10.75" OD and 10.02" ID. These were evenly spaced around a 4.67' radius circle. The outer tray downcomers were 18 lengths of 10" pipe evenly spaced around a circle with a 6.38' radius. The outer trays had an OD of 7.0' and an ID of 5.625'.

Downcomers were offset at every tray, inner and outer, so that the centerlines of the downcomers on the tray below lay mid-way, on an arc between the centerlines of two adjacent downcomers on a tray above. The actual offset distance therefore depends on the circle radius around which the downcomers are evenly spaced. This promotes some mixing of catalyst as it flows through the downcomers.

Results of pre- and post-modification operation are reported in the following table. Two types of stripping operation were considered, normal and high severity. High severity means we added more stripping steam.

TABLE

Commercial FCC Stripper Performance
Impact of Downcomer Modifications

| | | Before | | After | |
|---|---|---|---|---|---|
| Test Number | | 1 | 2 | 1 | 2 |
| Stripping Severity | | Normal | High | Normal | High |
| Unit Operating Conditions | | | | | |
| Catalyst Circulation | tpm | 56 | 58 | 56 | 58 |
| Stripping Steam | Mlb/hr | 27.0 | 38.5 | 24.0 | 34.5 |
| Stripping Severity | lb/Mlb cat | 3.7 | 5.3 | 3.6 | 4.9 |
| Combined Feed Rate | MB/D | 99.4 | 99.4 | 95.3 | 95.6 |
| Riser Top Temperature | deg F. | 999 | 999 | 999 | 1001 |
| Coke Yield | | | | | |
| USHC (Unstripped Hydrocarbon) | Mlb/hr | 9.5 | 8.0 | 3.9 | 3.0 |
| Total Coke | Mlb/hr | 63.7 | 64.4 | 63.2 | 65.3 |

TABLE-continued

| Commercial FCC Stripper Performance Impact of Downcomer Modifications | | | | | |
|---|---|---|---|---|---|
| | | Before | | After | |
| Test Number | | 1 | 2 | 1 | 2 |
| Stripping Severity | | Normal | High | Normal | High |
| (USHC + Coke) Stripper & Spent Standpipe Key Performance Indicators | | | | | |
| USHC/Total Coke (Mass) | wt % | 14.9 | 12.5 | 6.2 | 4.5 |
| USHC/Catalyst Circulation | wt % | 0.141 | 0.115 | 0.058 | 0.042 |
| Stripping Steam Upflow to Reactor | wt % | 20 | 21 | 64 | 70 |
| Stripping Steam Downflow to Standpipe | wt % | 80 | 79 | 36 | 30 |
| Restricted Catalyst Flux - Tray Section | lb/ft 2 · s | 39 | 40 | 31 | 32 |
| Stripper Density (above steam injection) | lb/ft 3 | 47.4 | 42.0 | 39.8 | 34.4 |
| Spent Standpipe Density | lb/ft 3 | 15.4 | 11.0 | 32.4 | 30.9 |

These data are from a commercial unit, so some changes may be due to normal changes in the plant operation. Even with this caution, the data are significant in showing drastic reductions in stripping steam sent to the regenerator and in unstripped hydrocarbon (USHC).

In the normal severity case the old design consigned 9,500 #/hr of valuable products to be burned in the regenerator. In our modified design we were able to reduce this waste to 4,300 #/hr, for a product savings of 5,200 #/hr.

In the high severity case the old design burned 8,000 #/hr of potentially recoverable hydrocarbon. Our modified stripper design burned only 3,200 #/hr at similar conditions, for a saving of 4,800 #/hr.

The old stripper sent only 20% of the stripping steam up the stripper, with the rest going into the regenerator. After the stripper was modified with downcomers, roughly 60–70% of the stripping steam passed up through the stripper.

The refiner increased severity of the unit to take advantage of the improved coke selectivity, achieving a significant increase in conversion and also ran a heavier feed.

In addition, the catalyst regenerator now runs drier, due to less steam addition from the stripper and less water of combustion formed in the regenerator. The benefits from this are reduced catalyst makeup rates and/or increased activity.

DISCUSSION

Our process improves FCC catalyst stripping in several ways. The improvements are primarily in the area of more active stripper volume, better mixing, and increased capacity. Refiners can take advantage of the improvement in a number of ways, including higher oil feed rate to the FCC unit, running heavier and cheaper oil feeds, or operating the unit at higher severity. Higher severity operation increases yields of premium products such as gasoline. Each area of improvement will be briefly reviewed, ending with a discussion of a new type of countercurrent contacting which we believe is occurring in our strippers.

STRIPPER ACTIVE VOLUME

There is an immediate, but modest, improvement in stripping from making more of the volume of the stripper active. The conventional approach to stripping created relatively dead regions—primarily under the plates used to distribute and redistribute catalyst.

Our approach to stripping replaces part of the dead region under the tray with more active contacting within the downcomers. This leads to a modest improvement in stripping efficiency.

IMPROVED MIXING

Current stripper designs presume that there are no minor or major flow disruptions in the stripper. This is rarely the case in commercial units, and the extra stages of mixing, and increased open area, provided by our downcomers may reduce bypassing caused by a slight out of round stripper, or trays that are not perfectly level. Some maldistribution may still occur, but there are more mixing stages or points as the catalyst passes through the stripper, ameliorating such flow maldistributions.

INCREASED CAPACITY

Catalyst strippers in most commercial units are severely overloaded. Our design greatly increases the capacity of the catalyst stripper. Thus we can have extremely high catalyst flow rates through the stripper, while continuing to send most of the stripping steam up through the stripper rather than through the regenerator.

The increased capacity is due to the increased open area of the trays. We get a large improvement in throughput without significant loss in efficiency because of good contacting in the downcomers.

STATIC/DYNAMIC HEAD

We do not wish to be bound by the following discussion of the mechanisms involved in our new stripping design, but believe it instructive to discuss why we think our new design works so well.

The interplay between gas and catalyst could be summarized as follows. In its simplest embodiment we believe we significantly improve stripping by permitting significant catalyst traffic in downcomers which are efficient contactors. We believe this will occur even with no lip at the top of the downcomer, and with bottom of the downcomer roughly flush with the bottom of the slant tray. At this level our invention provides additional area for catalyst traffic, in a region of efficient solids/vapor contact.

In its preferred embodiment (lip diverting catalyst into the downcomer at the top, and downcomer outlet recessed so that it taps into the bubble of relatively higher pressure gas under the slant tray), we load up the downcomer with spent catalyst and force larger amounts of stripping vapor through in countercurrent flow. The lip on the spent catalyst inlet diverts extra catalyst into our downcomer and helps ensure that every bit of dynamic head is used to get catalyst into the downcomer. We elevate the spent catalyst outlet at the base of the downcomer to force more gas to flow up through the downcomer.

This is an unusual approach to stripping, using static head (stripping vapor in the bubble) to counteract dynamic head (the stream of spent catalyst diverted into the downcomer).

Based on visual observations in our plexiglass model there is a significant amount of pulsing or oscillation of gas and catalyst flow. Visually the lip does not come into play very much, but its presence is still believed useful, both for at least sporadically diverting flowing catalyst into the "downcomer" and preventing its premature discharge when a pulse of gas and catalyst "spouts" up the vertical conduit.

COMMERCIAL APPLICABILITY

Our process and apparatus can be used in any type of FCC stripper using slant or shed trays, those wherein catalyst flows down from a dispensing tray (a slant surface tray or shed tray) and is directed onto the upper portion of a receiving tray (another slant tray or shed tray(s)) beneath but laterally displaced from the dispensing tray. The dispensing trays can be simple slant trays, or trays in the form of an inverted "V" which dispenses to two receiving trays.

The trays may be supported by being affixed along the length thereof to the walls of the stripper vessel (as in the case of annular strippers) or the ends of the trays may be welded or affixed to the walls of the vessel (shed tray designs). Lower trays may also support upper trays, or any combination of the above.

SIGNIFICANCE

The process and apparatus of the present invention allow refiners to improve one of the last great regions of inefficiency in FCC processing, the FCC stripper. Refiners have been plagued with strippers which left large amounts of potentially recoverable product on the spent catalyst, or which sent more stripping steam into the regenerator than up the stripper. We know from our commercial and laboratory tests that we solved the problem, and significantly increased the capacity of slant tray and shed tray FCC catalyst strippers.

We claim:

1. A fluidized catalytic cracking process wherein a heavy hydrocarbon feed comprising hydrocarbons having a boiling point above about 650° F. is catalytically cracked to lighter products by contact with a circulating fluidizable catalytic cracking catalyst inventory consisting of particles having a size ranging from about 20 to about 100 microns, comprising:

a. catalytically cracking said feed in a catalytic cracking reactor operating at catalytic cracking conditions by contacting feed with a source of regenerated catalyst to produce a cracking reactor effluent mixture comprising cracked products and spent catalyst containing coke and strippable hydrocarbons;

b. discharging and separating said effluent mixture into a cracked product rich vapor phase and a solids rich phase comprising spent catalyst;

c. removing said vapor phase as a product;

d. stripping said solids rich spent catalyst phase by countercurrent contact with a stripping vapor to produce stripped catalyst and stripper vapor in a stripper vessel having:

a plurality of slant trays for horizontal and vertical transfer of catalyst as it passes down through said stripper, each slant tray having a slanted surface affixed at an upper edge portion thereof to a wall portion of said stripping vessel and a lower edge or lip portion, and wherein each slant tray has an upper and a lower surface;

at least one inlet in a lower portion of said stripping vessel for stripping vapor;

at least one outlet in a lower portion of said stripping vessel for discharge of stripped catalyst;

at least one outlet in an upper portion of said stripping vessel for discharge of stripper vapors; and wherein downcomers are provided in at least some of said slant trays having:

a downcomer catalyst inlet in an upper portion thereof fluidly connected with the upper surface of said slant tray;

a generally vertical catalyst downcomer section having an upper portion terminating in said downcomer catalyst inlet and a lower portion terminating a downcomer catalyst outlet;

e. transporting stripped catalyst discharged from said stripper to a catalyst regenerator;

f. regenerating stripped catalyst by contact with oxygen containing gas to produce regenerated catalyst; and g. recycling said regenerated catalyst to said cracking reactor.

2. The process of claim 1 wherein said downcomer catalyst outlet extends down to the lower edge portion of the slant tray to which it is attached.

3. The process of claim 1 wherein said slant tray has a vertical height of 0.5 to 5' and said vertical section of said downcomer has a height equal to 50 to 110% of said vertical height of said slant tray.

4. The process of claim 1 wherein said slant tray slants at about 15° to about 75° from vertical.

5. The process of claim 1 wherein said slant tray slants at about 30° to about 60° from vertical.

6. The process of claim 1 wherein said downcomer inlet is flush with said slant tray.

7. The process of claim 1 wherein said slant tray has an angle X measured from a vertical axis of 40° to 65°, and said inlet of said downcomer has an angle Y measured from a vertical axis of 42.5° to 150°, and at least 2.5° greater than said angle X, said downcomer inlet has a higher portion and a lower portion, and said higher portion is flush with an upper surface of said slant tray and said lower portion extends above said slant tray.

8. The process of claim 1 wherein said downcomer outlet is at an elevation from about 0.5 to 5" above said lower edge or lip of said slant tray.

9. The process of claim 1 wherein said downcomer outlet is at an elevation from about 1 to 4" above said lower edge or lip of said slant tray.

10. The process of claim 1 wherein said stripper operates at 900° to 1250° F., with 1 to 10 weights of stripping steam added per thousand weights of catalyst passed through said stripper.

11. The process of claim 1 wherein said downcomer has a diameter and a centerline and said downcomer centerline is displaced horizontally from said lowermost edge or lip of said slant tray by 0.75 to 2.0 downcomer diameters.

12. The process of claim 1 wherein said downcomers are provided at at least two elevations and said downcomers are staggered through each elevation so that no downcomer outlet is in line with a superior or inferior downcomer outlet.

13. The process of claim 1 wherein each slant tray has a horizontal width of at least 6" and each downcomer has a diameter, or equivalent hydraulic diameter, ranging from 4" to 90% of said horizontal width of said slant tray.

14. A fluidized catalytic cracking process wherein a heavy hydrocarbon feed comprising hydrocarbons having a boiling point above about 650° F. is catalytically cracked to lighter products by contact with a circulating fluidizable catalytic cracking catalyst inventory consisting of particles having a size ranging from about 20 to about 100 microns, comprising:

a. catalytically cracking said feed in a catalytic cracking reactor operating at catalytic cracking conditions by contacting feed with a source of regenerated catalyst to produce a cracking reactor effluent mixture comprising cracked products and spent catalyst containing coke and strippable hydrocarbons;

b. discharging and separating said effluent mixture into a cracked product rich vapor phase and a solids rich phase comprising spent catalyst;

c. removing said cracked product rich vapor phase as a product;

d. stripping said solids rich spent catalyst phase by countercurrent contact with stripping vapor to produce stripped catalyst and stripper vapor in a stripper vessel having:

a plurality of slant trays blocking from 20 to 80% of a cross sectional area of said stripper vessel at a plurality of elevations in said stripper vessel for horizontal and vertical transfer of catalyst as it passes down through said stripper, each slant tray having:

an upstream portion receiving spent catalyst discharged and separated from said cracking reactor or from a superior tray, a downstream portion discharging spent catalyst from a tray edge or lip across and down to an inferior tray, and an upper and a lower surface;

at least one inlet in a lower portion of said stripping vessel for stripping vapor;

at least one outlet in a lower portion of said stripping vessel for discharge of stripped catalyst;

at least one outlet in an upper portion of said stripping vessel for discharge of stripper vapors; and vertical conduits in at least some of said slant trays comprising:

a combined spent catalyst inlet and vapor outlet passing through said slant tray which is fluidly connected with said upper surface of said slant tray, a combined spent catalyst outlet and vapor inlet beneath at least a portion of said lower surface of said slant tray and above said slant tray lip or edge, and a generally vertical conduit having an upper portion terminating in said combined inlet and outlet and a lower portion terminating in said combined outlet and inlet;

e. transporting stripped catalyst discharged from said stripper to a catalyst regenerator;

f. regenerating stripped catalyst by contact with oxygen containing gas to produce regenerated catalyst; and g. recycling said regenerated catalyst to said cracking reactor.

15. The process of claim 14 wherein said slant tray has a vertical height of 0.5 to 5' and said vertical section of said downcomer has a height equal to 50 to 110% of said vertical height of said slant tray.

16. The process of claim 14 wherein said slant tray slants at about 15° to about 75° from vertical.

17. The process of claim 14 wherein said slant tray slants at about 30° to about 60° from vertical.

18. The process of claim 14 wherein:

said slant tray has an angle X measured from a vertical axis of 40° to 65°;

said combined inlet and outlet has an angle Y measured from a vertical axis of 42.5° to 150°, and at least 2.5° greater than said angle X and has a higher portion and a lower portion, and said higher portion is flush with an upper surface of said slant tray and said lower portion extends above said slant tray to form a lip projecting above said slant tray; and said combined outlet and inlet is about 1 to 4" above said lower edge or lip of said slant tray.

* * * * *